US006763199B2

(12) United States Patent
Conrow et al.

(10) Patent No.: US 6,763,199 B2
(45) Date of Patent: Jul. 13, 2004

(54) SYSTEMS AND METHODS FOR ONE-STEP SETUP FOR IMAGE ON PAPER REGISTRATION

(75) Inventors: Brian R. Conrow, Rochester, NY (US); David M. Kerxhalli, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 233 days.

(21) Appl. No.: 10/046,166

(22) Filed: Jan. 16, 2002

(65) Prior Publication Data

US 2003/0133000 A1 Jul. 17, 2003

(51) Int. Cl.[7] ..... G03G 15/00
(52) U.S. Cl. ..... 399/15; 399/72
(58) Field of Search ..... 399/72, 15, 301; 347/116

(56) References Cited

U.S. PATENT DOCUMENTS

| | | | | |
|---|---|---|---|---|
| 4,248,528 | A | | 2/1981 | Sahay |
| 4,518,898 | A | * | 5/1985 | Tarnowski et al. |
| 4,627,721 | A | | 12/1986 | Nguyen et al. |
| 4,831,420 | A | * | 5/1989 | Walsh et al. |
| 5,040,003 | A | * | 8/1991 | Willis |
| 5,153,577 | A | | 10/1992 | Mackey et al. |
| 5,260,725 | A | | 11/1993 | Hammond |
| 5,374,993 | A | * | 12/1994 | Diehl et al. |
| 5,555,084 | A | | 9/1996 | Vetromile et al. |
| 5,600,408 | A | * | 2/1997 | Horiuchi et al. ..... 399/72 |
| 5,642,202 | A | | 6/1997 | Williams et al. |
| 5,697,608 | A | | 12/1997 | Castelli et al. |
| 5,697,609 | A | | 12/1997 | Williams et al. |
| 5,760,914 | A | | 6/1998 | Gauthier et al. |
| 5,821,971 | A | | 10/1998 | Rauch et al. |
| 5,889,545 | A | | 3/1999 | Rauch et al. |
| 6,137,517 | A | | 10/2000 | Furst et al. |
| 6,141,464 | A | | 10/2000 | Handley |
| 6,175,700 | B1 | * | 1/2001 | Miller et al. ..... 399/72 |
| 6,178,031 | B1 | | 1/2001 | Rauch et al. |
| 6,201,937 | B1 | | 3/2001 | Folkins |
| 6,275,244 | B1 | | 8/2001 | Omelchenko et al. |
| 6,452,147 | B1 | * | 9/2002 | Inada |
| 6,490,421 | B2 | * | 12/2002 | McIntyre ..... 399/15 |
| 6,512,585 | B1 | * | 1/2003 | Ikeda |
| 6,554,390 | B2 | * | 4/2003 | Arquilevich et al. |
| 2003/0044193 | A1 | * | 3/2003 | Thomas et al. ..... 399/72 |

* cited by examiner

*Primary Examiner*—Susan Lee
(74) *Attorney, Agent, or Firm*—Oliff & Berridge, PLC

(57) ABSTRACT

Initial setup of image to sheet (IOS) or image to paper (IOP) registration in a printing device such as, for example, an electrographic printer, is accomplished in a single step that uses an initial set of measurements to determine and correct each of the independent registration errors, including image squareness/ROS skew, image skew/paper skew, lateral magnification, process magnification, lateral direction IOS or IOP position, and process direction IOS or IOP position simultaneously. A set of algorithms is used to perform a series of geometrical transformations to determine each of the six errors affecting IOS or IOP registration.

33 Claims, 9 Drawing Sheets

SYSTEMS AND METHODS FOR ONE-STEP SETUP FOR IMAGE ON PAPER REGISTRATION

BACKGROUND OF THE INVENTION

1. Field of Invention

This invention is directed to systems and methods for setting up image on paper registration in a printing device.

2. Description of Related Art

In various reproduction systems, including xerographic printing, the control and registration of the position of imageable surfaces such as photoreceptor belts, intermediate transfer belts, if any, and/or images on such imageable surfaces, and the control and registration of images transferred to and developed on a substrate, such as for example, a sheet of paper, involve both initial and process control methods.

To adjust the registration of images on either or both axes, i.e., the lateral axis and/or the process direction axis, relative to the image bearing surface and to one another, includes adjusting the position or timing of the images being formed on the image bearing surface. That may be done, for example, by controlling the raster output scanner (ROS) imaging system or of any other included latent or visible image forming systems.

Various systems and methods have been developed to control registration of image on paper after an initial registration has been made. Examples of such registration systems include those shown and described in U.S. Pat. Nos. 5,821,971; 5,889,545; 6,137,517; 6,141,464; 6,178,031; and 6,275,244, the subject matter of each patent incorporated herein by reference in its entirety.

U.S. Pat. No. 5,642,202, the subject matter of which is incorporated herein by reference in its entirety, discloses a process for initial registration calibration of a printing system including a printer and a master test image document printed by the printer.

There are a number of sources of image on sheet (IOS) or image on paper (IOP) registration errors which may be addressed, including process magnification, lateral magnification, lateral margin shifts, process margin shifts, paper skew and/or imager skew. Process magnification is the magnification of the image in the process direction, i.e., the direction in which the substrate onto which the image is transferred and developed moves through the image transfer and developing apparatus. Lateral magnification is the magnification of the image in the lateral direction, i.e., in the direction substantially perpendicular to the process direction. Paper skew is the angular deviation of the longitudinal axis of the substrate in the process direction and/or the angular deviation of the lateral axis of the substrate perpendicular to the process direction. Imager skew is the angular deviation of the raster output scanner scan lines from the process direction or a line normal to the process direction.

The lateral margins are the spaces between each edge of the image transferred to and developed on the substrate and each adjacent edge of the substrate which is substantially parallel to the process direction. The process margins are the spaces between each edge of the image transferred to and developed on the substrate and each adjacent edge of the substrate which is substantially perpendicular to the process direction. It should be noted that, in many xerographic image forming devices, each image is exposed successively by one or more raster output scanner imagers. Each raster output scanner has a start of scan (SOS) sensor and an end of scan (EOS) sensor. These sensors, i.e., the start of scan (SOS) and end of scan (EOS) sensors, along with the delay before the first pixel is imaged after the start of scan occurs, and the associated timing of when the start of scan occurs, establish the lateral and process margins of a latent image which is to be developed and transferred to a substrate.

Because the effects of these possible image on sheet or image on paper registration errors are interrelated, conventional image on sheet or image on paper setup/calibration procedures first requires correcting for any paper skew and imager skew errors, then correcting for any lateral and process magnification errors, and then correcting for any lateral and process margin errors.

Each correction step may involve multiple iterations of printing and measuring test images and adjusting imaging system parameters before registration error magnitudes are reduced to acceptable levels. U.S. Pat. No. 4,627,721, the subject matter of which is incorporated herein by reference in its entirety, discloses automatic adjustment of optical components in an optical scanning systems after a technical representative has visually inspected sample copies of a test pattern and entered adjustment numbers at a control console. In one specific embodiment, one sample copy is compared by the technical representative with the test pattern to adjust the magnification setting and a sequence of a set of five copies are produced to allow coarse and fine adjustments to the focus.

SUMMARY OF THE INVENTION

This invention provides systems and methods that use an initial set of measurements to determine and reduce each of a number of image on paper registration errors in a single operator step.

This invention separately provides systems and methods that use an initial set of measurements to determine and reduce each of a number of image on paper errors in a single operator step.

This invention separately provides systems and methods that use an initial set of measurements and that compensate for different paper types and sizes.

This invention separately provides systems and methods that use an initial set of measurements to determine and reduce each of a number of image on paper errors in a single operator step and that compensate for different rates of paper shrinkage.

The invention separately provides systems and methods that employ a set of algorithms that uses an initial set of measurements to determine and reduce each of a number of image on paper errors in a single operator step and that compensate for different paper types and sizes.

This invention separately provides systems and methods that employ algorithms that use an initial set of measurements to determine and reduce each of a number of image on paper registration errors in a single operator step.

This invention separately provides systems and methods that employ algorithms that use an initial set of measurements to determine and reduce each of a number of image on paper errors in a single operator step and that compensate for different rates of paper shrinkage.

In various exemplary embodiments of the systems and methods of this invention, a set of measurements is made on a test print and a series of geometrical transformations is made based on the measurements to determine a plurality of registration errors, including one or more of process magnification errors, lateral magnification errors, process margin errors, lateral margin errors, paper skew errors and imager skew errors, which affect image on paper registration.

In various exemplary embodiments of the systems and methods of this invention, the geometrical transformations are performed by algorithms which are shown and described herein. The geometrical transformations are then used to make adjustments to appropriate actuators so that image on sheet (IOS) or image on paper (IOP) registration is within desired specifications. Examples of such actuators include pixel clock frequency, photoreceptor speed, ROS scan lateral margin delay; process direction delays, paper steering systems, etc. The algorithms disclosed in this application may be modified to be used with a variety of printing systems and methods.

In various exemplary embodiments of the systems and methods of the invention, printing system mis-registration adjustments may include adjusting a pixel clock frequency and/or a photoreceptor belt or drum speed, adjusting the first pixel delay after the start of scan (SOS) signal, varying the sheet timing and/or position in the paper path, adjusting the ROS angular position relative to the photoreceptor among other techniques. The incorporated patents indicate several printing parameters which can be varied to achieve proper registration of images on paper. In various exemplary embodiments of the systems and methods of this invention, paper shrink effects on registration can be compensated for using determinations made on a number of different papers, such as, for example, evaluating the same test pattern on different substrates. Moreover, a paper conditioner to pre-shrink or re-wet the paper may be used to compensate for different known substrate shrinkage rates.

In various exemplary embodiments of the systems and methods of this invention, the measurements are made on both sides of a duplex substrate or sheet to optimize image on paper registration for duplex printing.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Before an image-on-paper registration setup operation for an electrophotographic printer is performed, it is likely that there are errors in the photoreceptor belt or drum speed and the pixel clock frequency. These errors would result in process and lateral magnification errors, respectively, as the image is exposed on the photoreceptor belt or drum. After the image is transferred, the image is subsequently fused to a sheet of paper, and the paper, along with the images on the paper, shrinks, thereby compounding the magnification errors. There is no direct way to differentiate between the original photoreceptor belt or drum speed error, the pixel clock frequency error and the error caused by paper shrinkage. Also, in duplex printing, because the first-formed image passes through the fuser one more time than does the second-formed image, there is also a difference between the magnification error in the image on the first side of the sheet and the magnification error in the image on the second side of the sheet.

In some printing devices, registration occurs at the outboard edge and the leading edge of the sheet for the first side, and at the outboard edge and the trailing edge of the sheet for the second side. It should be appreciated that the exemplary equations outlined below are tailored for this sort of printing device. Of course, it will be readily apparent to those of ordinary skill in this art how to modify the following equations for devices that use other registration schemes.

In such devices, the residual magnification errors affect process registration on the second side. According to the methods of this invention, including the techniques set forth below, which are expressed through equations that include the edge parameters discussed above, the operator of the printer performs the measurements described below on both sides of a sheet in order to optimize image on sheet and/or image on paper (IOS/IOP) registration for duplex printing. Additionally, a margin shift may be invoked to compensate for the setup errors due to the residual magnification error, as well as for the show through errors, as shown and described in copending patent application Ser. No. 09/682, 379, filed on Aug. 27, 2001, the disclosure of which is incorporated herein by reference in its entirety.

Figure 1:
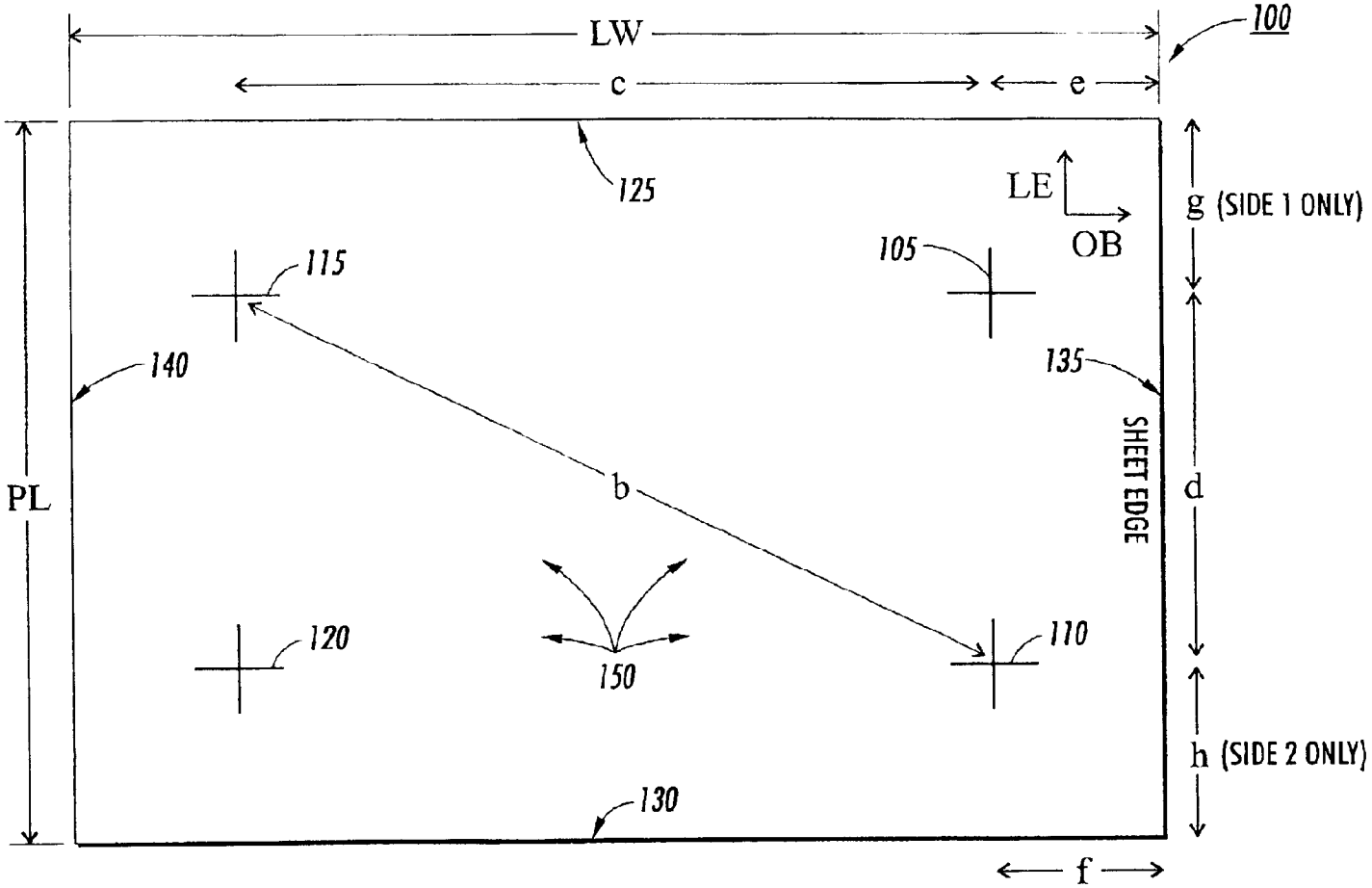
FIG. 1 is a top view of a sheet on which a registration test pattern has been printed.

FIG. 1 illustrates a sheet 100 on which a registration test pattern has been printed. For the purpose of description only, the horizontal and vertical axes of the sheet 100 are referred to relative to the direction that the sheet moves through a printing apparatus. The process length (PL) is the length of an edge of the sheet 100 that runs parallel to the direction that a sheet 100 is fed through a printing apparatus. The lateral width (LW) of the sheet 100 is the length of an edge of the sheet 100 that runs perpendicular to the direction that the sheet 100 is fed through a printing apparatus.

The four edges of a sheet 100 can also be described relative to the direction that the sheet 100 moves through the printing apparatus. The outboard edge (OB) 135 and the inboard edge (IB) 140 are the edges that define the process length. The outboard edge 135 can refer to the edge of sheet 100 closest to the registration surface of the printing apparatus, and the inboard edge 140 to the opposite edge, i.e., the edge farthest from a registration surface, or vice versa. The leading edge (LE) 125 and the trailing edge (TE) 130 are the edges that define the lateral width of the sheet 1100. The leading edge 125 is the forward edge as the sheet 100 moves through a printing apparatus, and the trailing edge 130 is the opposite edge.

Also, solely for the purpose of description, margin corrections towards different edges of the sheet 100 are given different signs. Adjustments towards the inboard and leading edges 140 and 125 of the sheet 100 are given a negative sign. Adjustments towards the outboard and trailing edges 135 and 130 are given a positive sign. The signs and names assigned to various aspects of the sheet 100 are not intended to limit the systems and methods according to the invention. The methods of this invention can be readily applied to any simplex and/or duplex printing apparatus for printing on any type of substrate, regardless of the names given to define various parts of the sheet 100.

During the setup operation, a user prints out a predetermined number of sheets having a registration geometries test pattern 150 shown in FIG. 1. The test pattern 150 can vary in its content. In the exemplary embodiment of the test pattern 150 shown in FIG. 1, the test pattern 150 includes four crosshairs 105, 110, 115 and 120 positioned at the corner of a rectangle. The test pattern 150 can be printed in any color, including one of the subtractive or additive color primaries, or an achromatic color, e.g., black or gray, or any combination of colors. The test pattern 150 can include a distance scale (not shown) to facilitate measurements of physical parameter, e.g., length, width, angle, and the like.

A user or operator then carries out the measurements described below on one side or both sides of a sheet on which the test pattern 150 has been printed to improve registration for simplex or duplex printing, respectively. For simplex printing, the user or operator prints the test pattern 150 on, and measures one side of, the sheet. Those measurements may then be used for the second side, i.e., the corresponding values on the second side of a sheet will be set equal to the first sheet side measured values. This allows the same equations to be used for both simplex and duplex printing since the algorithms require measured input for both sides of the sheet. For duplex printing, the user or operator prints the test pattern 150 on both sides of the sheet, and separately measures both test patterns 150. Measurements may be automatically with photodetecting and/or imaging devices or may be made manually, i.e., visually, with the unaided eye or with an optical element, such as, for example, a loupe. The loupe may include its own measurement scale(s) or a separate measurement scale may be provided by or for the user or operator as a separate element or as part of the test pattern or a test sheet. That is, suitable measurement scale(s) may be provided on the sheet and/or in the test pattern itself.

The user or operator then makes the following measurements on the one or more test patterns 150 which have been printed onto the sheet 100 by the electrophotographic or other image forming device. Although these measurements are listed in a particular order, the measurements may be made in any order.

A first measurement to be made by a user or operator, automatically or manually, is used to determine the image squareness error, also known as raster output scanner skew. Determining the image squareness error involves measuring a distance b on the first side of a sheet, as shown in FIG. 1, illustratively expressed in millimeters. The distance b is the distance between the center of the leading edge inboard crosshair 115 and the center of the trailing edge outboard crosshair 110. Alternatively, the measurement may be made with respect to the second side of the sheet. Determining the image squareness error also requires measuring the distance c, illustratively expressed in millimeters, between the center of the leading edge crosshair 105 and the center of the leading edge crosshair 115 and measuring the distance d, illustratively expressed in millimeters, between the center of the crosshair 105 and the center of the crosshair 110.

A second error to be determined is the image skew on the sheet 100, which is also known as paper skew. Determining this error requires measuring a distance e, illustratively expressed in millimeters, from the outboard side of the sheet to the center of the crosshair 105, a distance f, illustratively expressed in millimeters, from the outboard (OB) edge of the sheet to the center of the trailing edge crosshair 110, and a distance d, illustratively expressed in millimeters, between the center of the leading edge outboard crosshair 105 and the center of the trailing edge outboard crosshair 110. It should be appreciated that the distance d will already have been obtained during the measurements for determining the image squareness error.

A third error to be determined is the lateral magnification. Determining the magnitude of this error requires measuring the distance c, illustratively expressed in millimeters, between the center of the leading edge crosshair 105 and the center of the leading edge crosshair 115. It should be appreciated that the distance c will already have been obtained during the measurements for determining the image squareness error.

A fourth error to be determined is the process magnification. Determining the magnitude of this error requires measuring the distance d, illustratively expressed in millimeters, between the center of the crosshair 105 and the center of the crosshair 110. It should be appreciated that the distance d will already have been obtained during the measurements for determining the image squareness error.

A fifth error to be determined is the image to paper position in the lateral direction. Determining the magnitude of this error requires measuring the distance e, illustratively expressed in millimeters, from the outboard edge of the sheet to the center of the crosshair 105. It should be appreciated that the distance e will already have been obtained during the measurements for determining the paper skew error.

A sixth error to be determined is the image to paper position in the process direction. For this example, the system is lead-edge-registered on the first side 1 and is trail edge registered on the second side. Determining the magnitude of these errors require measuring the distance g, illustratively expressed in millimeters, from the leading edge of the first side of the sheet to the center of the crosshair 105 on the first side of the sheet, and/or measuring the distance h, illustratively expressed in millimeters, from the trailing edge of the second side of the sheet to the center of the trailing edge outboard crosshair on the second side of the sheet.

Measurements of distances to the edges of the paper, i.e., the distances e, f, g and h should be made along the legs of the crosshairs. This will not always be the perpendicular distance to the edge of the sheet but the algorithms set forth below, including those relating to target rotation, account for this.

In order to determine paper skew, the amount of rotation (θ) of the sheet about the outboard registration edge is obtained, using the following equation:

$$\theta=(\tan^{-1}[(f_1-e_1)/d_1]+\tan^{-1}[(f_2-e_2)/d_2])/2 \quad (1)$$

where:

- θ is the amount of rotation of the paper about the outboard (OB) registration edge;
- $d_1$ is the distance between the two leading edge (LE) crosshair centers on the first side of the sheet shown in FIG. 1;
- $e_1$ is the distance from the outboard (OB) edge of the sheet to the center of the leading edge (LE) outboard (OB) crosshair on the first side of the sheet shown in FIG. 1;
- $f_1$ is the distance from the outboard (OB) edge of the sheet to the center of the trailing edge (TE) outboard (OB) crosshair on the first side of the sheet shown in FIG. 1;
- $d_2$ is the distance between the two leading edge (LE) crosshair centers on the second side of the sheet shown in FIG. 1;
- $e_2$ is the distance from the outboard (OB) edge of the sheet to the center of the leading edge (LE) outboard (OB) crosshair on the second side of the sheet shown in FIG. 1; and
- $f_2$ is the distance from the outboard (OB) edge of the sheet to the center of the trailing edge (TE) outboard (OB) crosshair on the second side of the sheet shown in FIG. 1.

Figure 2:
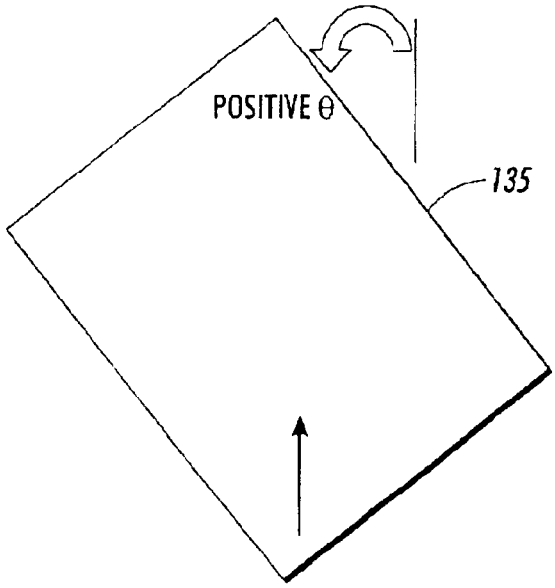
FIG. 2 is a top view of a sheet which illustrates a first paper skew parameter used in the sheet registration systems and methods according to the invention.

FIG. 2 illustrates parameters used in Eq. 1. FIG. 2 shows the outboard (OB) registration edge of a sheet and a sheet which has been rotated or skewed by a positive angle θ. A counterclockwise sheet rotation from the outboard registration edge, when viewed from above, is considered a positive rotation or positive skew. This convention may be reversed, if desired.

Figure 3:
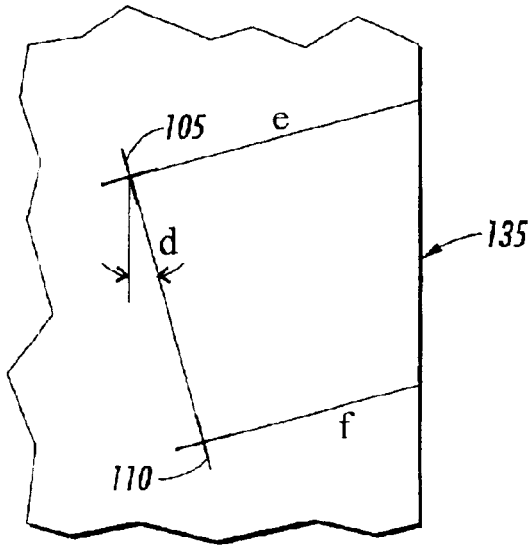
FIG. 3 is a top view of a sheet which illustrates a second paper skew parameter used in the sheet registration systems and methods according to the invention.

FIG. 3. shows the angle θ expressed in radians, in terms of the dimensions d, e, and f, where d is the distance between crosshairs 105 and 110. In this illustration, θ is considered to have a negative rotation or skew. Using the sign convention illustrated in FIG. 2, a negative skew would mean that, after the image is transferred onto the sheet, a target near the lead edge of the sheet would be further inboard than a target near the trail edge. This is represented by the fact that distance e is larger than the distance f.]

To determine the sheet squareness, ϕ, the distances $b_1$, $b_2$, $c_1$, $c_2$, $d_1$ and $d_2$ need to be measured. The distance $c_1$ is the distance between the centers of the leading edge (LE) crosshairs on the first side of the sheet. The distance $c_2$ is the distance between the centers of the leading edge (LE) crosshairs on the second side of the sheet. The distance $b_1$ is the distance between the center of the leading edge (LE) inboard (IB) crosshair and the center of the trailing edge (TE) outboard (OB) crosshair on the first side of the sheet. The distance $b_2$ is the distance between the center of the leading edge (LE) inboard (IB) crosshair and the center of the trailing edge (TE) outboard (OB) crosshair on the second side of the sheet.

Based on these measurements, the squareness of $\phi_1$ and $\phi_2$ of each side of the sheet, and the overall squareness ϕ can be determined as:

$$\phi_1=\sin^{-1}[(c_1^2+d_1^2-b_1^2)/(2*c_1*d_1)] \quad (2)$$

$$\phi_2=\sin^{-1}[(c_2^2+d_2^2-b_2^2)/(2*c_2*d_2)] \quad (3)$$

$$\phi=(\phi_1+\phi_2)/2 \quad (4)$$

where:

- $\phi_1$ is the amount of rotation of the raster output scanner (ROS) about an axis perpendicular to the photoreceptor belt surface with respect to the first side of the sheet;
- $\phi_2$ is the amount of rotation of the raster output scanner (ROS) about an axis perpendicular to the photoreceptor (PR) belt surface with respect to the second side of the sheet; and
- ϕ=the average or overall amount of rotation of the raster output scanner (ROS) about an axis perpendicular to the PR belt surface.

Figure 4:
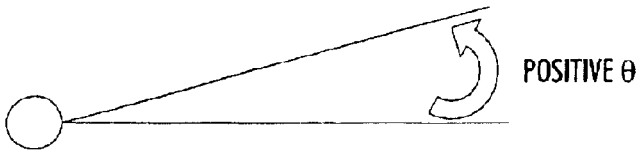
FIG. 4 is a top view of a sheet which illustrates a first image squareness/ROS skew parameter used in the sheet registration systems and methods according to the invention.

FIG. 4 shows the rotation ϕ of the raster output scanner (ROS) about an axis perpendicular to the photoreceptor (PR) belt surface.

Figure 5:
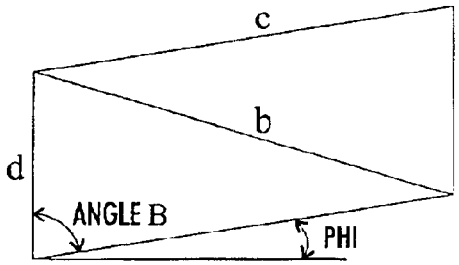
FIG. 5 is a top view of a sheet which illustrates a second image squareness/ROS skew parameter used in the sheet registration systems and methods according to the invention.

FIG. 5 shows a geometric illustration of how to obtain angle B using the law of cosines. The distance b is shown in FIG. 5 as a bisector of the parallelogram formed by sides c and d.

Then, the lateral magnification error $L_{ME1}$ for the first side, and the lateral magnification error $L_{ME2}$ for the second side are:

$$L_{ME1}=(c_{nom}-c_1)/c_{nom} \quad (5)$$

$$L_{ME2}=(c_{nom}-c_2)/c_{nom} \quad (6)$$

$$L_{ME}=(L_{ME1}+L_{ME2})/2 \quad (7)$$

where:

- $c_{nom}$ is the nominal distance between the two leading edge crosshairs for the first and second sides of the sheets; and
- $L_{ME}$ is the average lateral magnification error of side 1 and side 2.

It should be noted that both raster output scanner (ROS) pixel clock frequency errors and paper shrink errors affect the first and second side lateral magnification errors $L_{ME1}$ and $L_{ME2}$.

The first and second process magnification errors $P_{ME1}$ and $P_{ME2}$, and the overall process magnification error $P_{ME}$, are:

$$P_{ME1}=(d_1-d_{nom})/d_{nom} \quad (8)$$

$$P_{ME2}=(d_2-d_{nom})/d_{nom} \quad (9)$$

$$P_{ME}=(P_{ME1}+P_{ME2})/2 \quad (10)$$

where $d_{nom}$ is the normal distance between the two leading edge crosshair centers for the first and second sides of the sheet.

It should be noted that photoreceptor (PR) speed errors, ROS MPA (motor polygon assembly) speed errors, and paper shrink errors can affect the process magnification errors $P_{ME1}$ and $P_{ME2}$.

Figure 6:
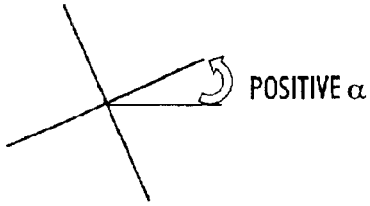
FIG. 6 is a top view of a sheet which illustrates a first skew parameter used in the sheet registration systems and methods according to the invention.

FIG. 6 shows the target rotation angle $\alpha$ with respect to a crosshair. The target rotation angle $\alpha$ is determined by subtracting the amount of rotation of the paper about the outboard (OB) registration edge, i.e., $\theta$, from the amount of rotation $\phi$ of the raster output scanner (ROS) about an axis perpendicular to the photoreceptor (PR) belt surface, i.e., $\alpha$ is:

$$\alpha=\phi-\theta \tag{11}$$

The target images on the registration geometries test pattern will be slightly rotated whenever there are any image skew (image squareness) errors or paper skew errors. This rotation needs to be taken out of the user measurements. Eq. 11 is used to achieve this.

By calculating the rotation of the target crosshairs, any errors induced in the measuring process can be compensated for. Because it is not easy to manually measure the perpendicular distance from the target to the edge of the sheet, the distance from the intersection (center) of the crosshairs to the edge of the sheet is to be measured along the leg of the crosshair, which is only nominally perpendicular to the edge of the sheet. Because the amount of rotation of the target crosshair legs can be determined from both the paper skew and the raster output scanner skew, the true perpendicular distance of the target (i.e., the center of the crosshairs) to the edge of the paper can be determined based on $\alpha$.

It should be realized, however, that for an automatic, e.g., scanner based, measurement system that can measure from the intersection (center) of the target crosshairs to the perpendicular edge of the sheet, this step may be skipped because any rotation of the target will have no impact on the measurement.

The error in the measured distances e–h due to the rotation a of the crosshairs 105–120 relative to the outboard edge 135 is:

$$\Delta e_\alpha=e_1*(1-\cos(\alpha)) \tag{12}$$

$$\Delta f_\alpha=f_2*(1-\cos(\alpha)) \tag{13}$$

$$\Delta g_\alpha=g_1*(1-\cos(\theta)) \tag{14}$$

$$\Delta h_\alpha=h_2*(1-\cos(\theta)) \tag{15}$$

where:

g is the distance from the leading edge of the first side of the sheet to the center of the leading edge (LE) outboard (OB) crosshair; and h is the distance from the trailing edge of second side of the sheet to the center of trailing edge (TE) outboard (OB) crosshair.

Figure 7:
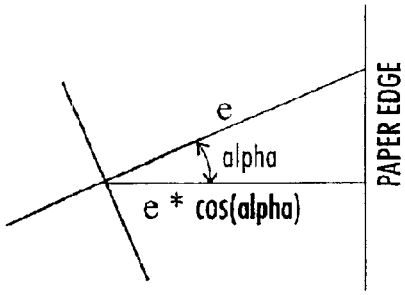
FIG. 7 is a top view of a sheet which illustrates a second skew parameter used in the sheet registration systems and methods according to the invention.
Figure 8:
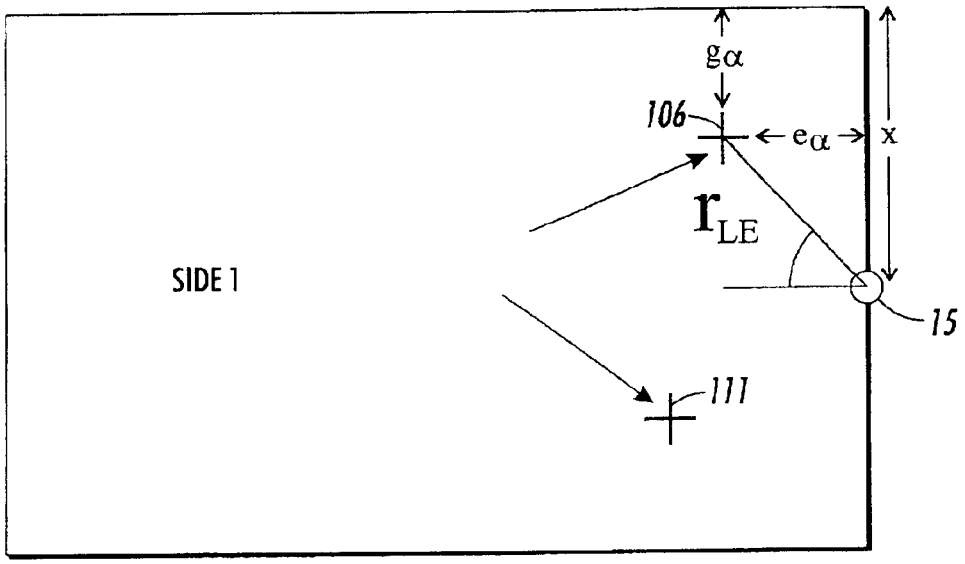
FIG. 8 is a top view of a first side of a sheet which illustrates a relationship between a paper sheet pivot point and outboard (OB) sheet side targets used in the sheet registration systems and methods according to the invention.
Figure 9:
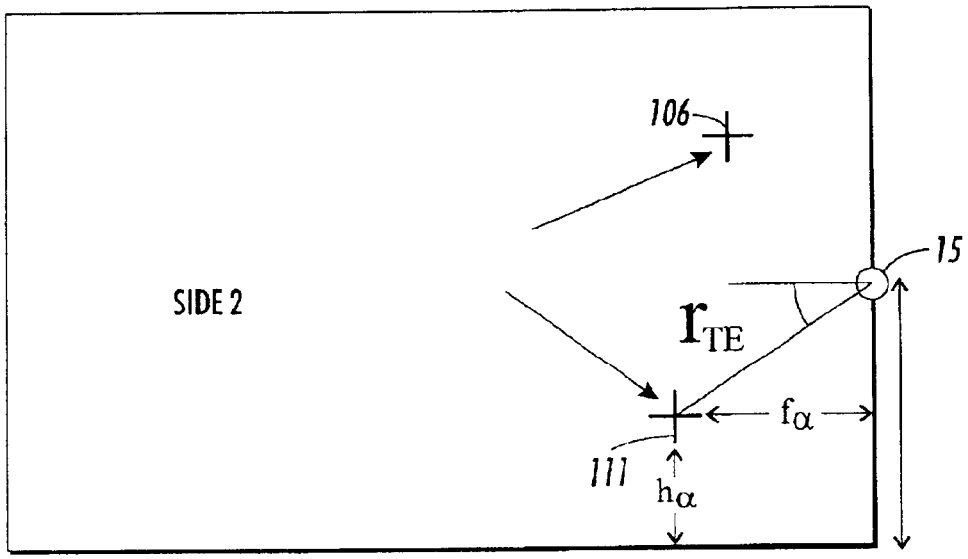
FIG. 9 is a top view of a second side of the sheet which illustrates another relationship between a paper sheet pivot point and outboard (OB) sheet side targets used in the sheet registration systems and methods according to the invention.

FIG. 7 illustrates the geometric relationship between the edge of a sheet, a target crosshair and the distance e, which may be measured on either or both sides of the sheet.

The paper skew affects the parameters e, f g, and h while the raster output scanner (ROS) skew only affects the parameters e and f. The actual distance from the center of the crosshairs 105–120 had there been no target rotation is thus:

$$e_\alpha=e_1-\Delta e_\alpha \tag{16}$$

$$f_\alpha=f_2-\Delta f_\alpha \tag{17}$$

$$g_\alpha=g_1-\Delta g_\alpha \tag{18}$$

$$h_\alpha=h_2-\Delta h_\alpha \tag{19}$$

The distance from the first or obverse side outboard (OB) leading edge (LE) error adjusted target 106 to a pivot point 250 of the outboard paper edge is:

$$r_{LE}=\sqrt{(x-g_a)^2+(e_a)^2} \tag{20}$$

where:

$r_{LE}$ is the distance from the pivot point of the OB paper edge to the location of the LE target had there only been paper skew and margin errors; and x is the distance from the pivot point 250 to the leading edge.

Figure 10:
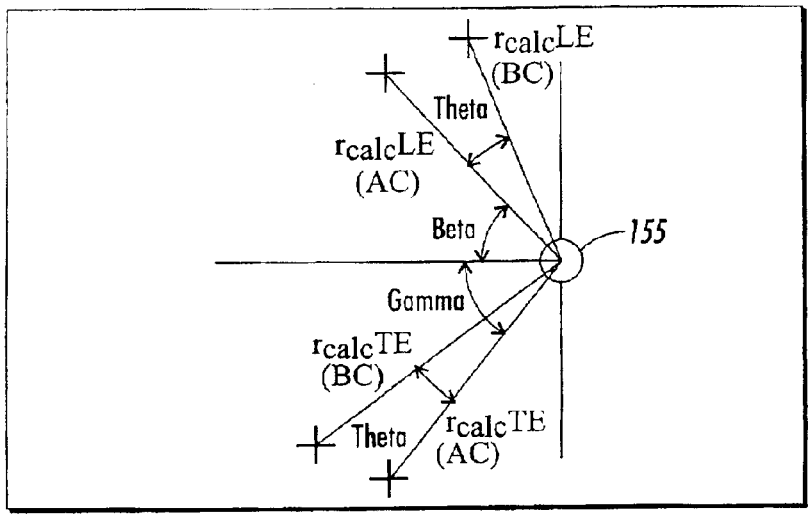
FIG. 10 is a top view of a sheet which illustrates various parameters used in the invention and shows registration target position with only margin errors and with both margin and skew errors.
Figure 11:
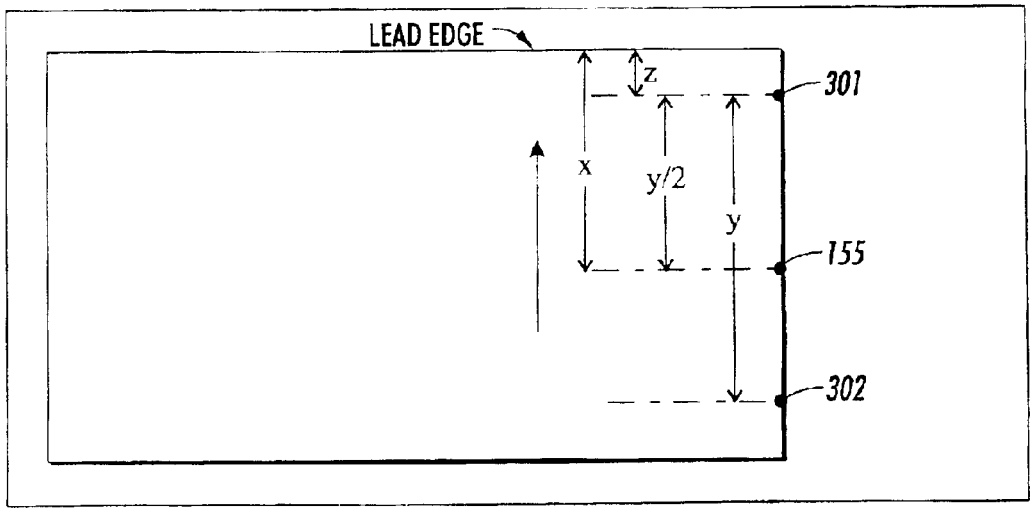
FIG. 11 is a top view of a sheet with its leading edge, its relationship to leading edge and trailing edge sensors, and relationships between the sensors and the leading edge of the paper.

In an electrophotographic or other printing system, leading edge and trailing edge sensors, such as, for example, CCD sensors, which are used for lateral registration, may be nominally spaced apart a given distance y. When the leading edge of a sheet is a certain distance z, past the leading edge sensor 301, e.g., a CCD sensor, both the leading edge sensor 301 and trailing edge sensor 302 record the position of the outboard sheet edge. A registration steering system maneuvers the sheet so that the appropriate leading edge and trailing edge pixels on the CCD are covered. Assuming no margin error, the pivot point of the sheet is the centerpoint between the leading edge sensor 301 and trailing edge CCD sensor 302. In this example, this would be the distance x=z+y/2 past the leading edge of the sheet. FIGS. 8–11 illustrate these relationships. FIG. 10, shows target position with margin and skew errors, labeled (BC) which means before skew error correction, and shows target position without skew errors, i.e., with only margin errors, labeled (AC) which means after skew error correction. FIG. 11 shows dimensions x, y and z, pivot point location and leading edge and trailing edge sensor locations.

The angular location of the first or obverse side outboard leading edge target 106 relative to the pivot point 155 of the outboard paper edge, is:

$$(\beta+\theta)=\cos^{-1}[e_\alpha/r_{LE}] \tag{21}$$

where $\beta$ is the angular position of the leading edge target relative to the pivot point of the outboard paper edge had there been no paper skew errors.

The angular location of the first or obverse side outboard leading edge target 106 relative to the pivot point 155 of the outboard paper edge, when the only errors are lateral and process errors, is:

$$\beta=(\beta+\theta)-\theta. \tag{22}$$

The distance from the second or reverse side outboard trailing edge error-adjusted target 106 to the pivot point 155 of the outboard sheet edge is:

$$r_{TE}=\sqrt{(P_{L-x-h_\alpha})^2+(f_a)^2} \tag{23}$$

where:

$L_P$ is the process length of the sheet; and $r_{TE}$ is the distance from the pivot point of the OB paper edge to the location of the trailing edge target had there only been paper skew and margin errors.

The angular location of the second or reverse side outboard trailing edge error-adjusted target 106 relative to the pivot point 155 of the outboard sheet edge is:

$$(\gamma-\theta)=\cos^{-1}[f_\alpha/r_{TE}] \tag{24}$$

where $\gamma$ is the angular position of the outboard trailing edge error adjusted target 106 relative to the pivot point 155 of the outboard sheet edge had there been no paper skew errors.

The angular location of the second or reverse side outboard trailing edge error-adjusted target 106 relative to the center point of the outboard sheet edge when the only errors were lateral and process margin errors is:

$$\gamma=(\gamma-\theta)+\theta. \tag{25}$$

The errors $\Delta e_\theta$, $\Delta f_\theta$, $\Delta g_\theta$ and $\Delta h_\theta$ in the parameters e, f, g and h due to paper skew are:

$$\Delta e_\theta=r_{LE}*\cos(\ominus+\theta)-r_{LE}*\cos(\beta) \tag{26}$$

$$\Delta f_\theta=r_{TE}*\cos(\gamma-\theta)-r_{TE}*\cos(\gamma) \tag{27}$$

$$\Delta g_\theta=r_{LE}*\sin(\beta)-r_{LE}*\sin(\beta+\theta) \tag{28}$$

$$\Delta h_\theta=r_{TE}*\sin(\gamma)-r_{TE}*\sin(\gamma-\theta) \tag{29}$$

where:

- $r_{LE}$ is the distance from the pivot point of the OB paper edge to the location of the LE target had there only been paper skew and margin errors;
- $r_{TE}$ is the distance from the pivot point of the OB paper edge to the location of the trailing edge target had there only been paper skew and margin errors;
- $\gamma$ is the angular position of the outboard trailing edge error adjusted target 106 relative to the pivot point 155 of the outboard sheet edge had there been no paper skew errors; and
- $\beta$ is the angular position of the leading edge target relative to the pivot point of the outboard paper edge had there been no paper skew errors;

The values of the distances $e_{\alpha\theta}$, $f_{\alpha\theta}$, $g_{\alpha\theta}$ and $h_{\alpha\theta}$ after accounting for the paper skew are:

$$e_{\alpha\theta}=e_\alpha-\Delta e_\theta \tag{30}$$

$$f_{\alpha\theta}=f_\alpha-\Delta f_\theta \tag{31}$$

$$g_{\alpha\theta}=g_\alpha-\Delta g_\theta \tag{32}$$

$$h_{\alpha\theta}=h_\alpha-\Delta e_\theta \tag{33}$$

The errors $\Delta e_\phi$, $\Delta f_\phi$, $\Delta g_\phi$ and $\Delta h_\phi$ in the parameters e, f, g and h due to raster output scanner (ROS) skew are:

$$\Delta e_\phi=(r_P-L_{ME1}*S)*(1-\cos(\phi)) \tag{34}$$

$$\Delta f_\phi=(r_P-L_{ME2}*S)*(1-\cos(\phi)) \tag{35}$$

$$\Delta g_\phi=-(r_P-L_{ME1}*S)*(\sin(\phi)) \tag{36}$$

$$\Delta h_\phi=(r_P-L_{ME2}*S)*(\sin(\phi)) \tag{37}$$

where:

- $r_P$ is the nominal distance from the inboard raster output scanner (ROS) pivot point to the intersection of the outboard crosshairs 105 and 110; and
- S is the nominal distance from the start of scan (SOS) sensor to the intersection of the outboard crosshairs.

Figure 12:
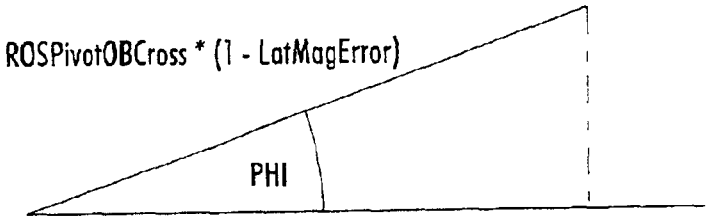
FIG. 12 is a geometric illustration of some parameters used in the sheet registration systems and methods according to the invention.

Eqs. 34–37 define the difference in what the measurements for the distances e, f, g and h would have been had there been no raster output scanner (ROS) skew. FIG. 12 geometrically illustrates raster output scanner (ROS) skew.

The values of the distances $e_{\alpha\theta\phi}$, $f_{\alpha\theta\phi}$, $g_{\alpha\theta\phi}$ and $h_{\alpha\theta\phi}$ after accounting for the raster output scanner (ROS) skew are:

$$e_{\alpha\theta\phi}=e_{\alpha\theta}-\Delta e_\phi \tag{38}$$

$$f_{\alpha\theta\phi}=f_{\alpha\theta}-\Delta f_\phi \tag{39}$$

$$g_{\alpha\theta\phi}=g_{\alpha\theta}-\Delta g_\phi \tag{40}$$

$$h_{\alpha\theta\phi}=h_{\alpha\theta}-\Delta h_\phi \tag{41}$$

To determine the lateral shrink paper errors, the following equations are used.

The shrink error is defined as always being negative. In cases where the pixel clock frequency is the reference for lateral magnification, a negative error indicates that the image is too large. Thus, in the lateral direction, a negative magnification error means the image is larger but negative shrink error means the image is smaller. The lateral first pass shrink error $f_{IL}$ is thus:

$$f_{1L}=(c_1/c_2-1). \tag{42}$$

Thus, $S_{LE1}$ is the net amount of shrink, after re-growth, that occurs on side 1 in the lateral direction.

$$S_{LE1}=x*f_{1L} \tag{43}$$

It should be noted that this assumes that the net shrink of the paper is, on average, some percentage, x, of the first pass shrink rate. For a particular system, an example value of x might be 50%, based on testing of various paper types.

To determine the second side shrink error, $f_{2L}$, a number of additional parameters need to be determined first. The measured magnification error on the first side, $L_{ME1}$, is the result of the original pixel clock frequency error, the shrink error $f_{1L}$ that occurs during the first pass through the fuser, the shrink error $f_{2L}$ that occurs during the second pass through the fuser, and the re-acclimation (re-growth) of the paper. That is, the measured first side lateral magnification error $L_{ME1}$ is:

$$L_{ME1}=1-(1-m_L)*(1+f_{1L})*(1+f_{2L})*(1+g_L) \tag{44}$$

where:

- $m_L$ is the initial Pixel Clock Frequency (PCF) error:
  - $f_{1L}$ is the first pass shrink rate in the lateral direction.
  - $f_{2L}$ is the second pass shrink rate in the lateral direction; and
  - $g_L$ is the re-acclimation, or growth rate in the lateral direction.

The first side net shrink amount is thus:

$$\begin{aligned} S_{LEI} &= (1+f_{1L})*(1+f_{2L})*(1+g_L)-1 \\ &= x*f_{1L} \end{aligned} \tag{45}$$

The second side net shrink amount is then:

$$S_{LE2}=(1+f_{2L})*(1+g_L)-1 \tag{46}$$

Solving for $S_{LE2}$ in terms x and $f_{1L}$, obtains:

$$S_{LE2}=(1+S_{LE1})/(1+f_{1L})-1 \tag{47}$$

The original pixel clock frequency error can then be solved by using the equation for the first side lateral magnification error from Eq. (44):

$$m_L=(L_{ME1}-1)/(S_{LE1}+1)+1 \tag{48}$$

To determine the process paper shrink error, the following equations are used.

$$P_{ME1}=1-(1-m_P)*(1+f_{1P})*(1+f_{2P})*(1+g_P) \tag{49}$$

where:

- $m_P$ is the initial belt speed error:
  - $f_{1P}$ is the first pass shrink rate in the process direction.

$f_{2P}$ is the second pass shrink rate in the process direction;

$g_P$ is the re-acclimation, or growth rate in the process direction;

$$f_{1P}=(d_1/d_2-1) \tag{50}$$

The first pass shrink rate in the process direction, $f_{1P}$, is the amount of shrink that occurs in the process direction during the first pass through the fuser.

The net amount of shrink $S_{PE1}$, after re-growth, that occurs on side 1 in the process direction, is:

$$S_{PE1}=y*f_{1P} \tag{51}$$

This assumes that the net shrink of the paper is, on average, some percentage, y, of the first pass shrink rate. For a particular system, an example value of y might be 30%, based on testing of various paper types.

The second pass shrink rate in the process direction, $f_{2P}$, is the amount of shrink that occurs in the process direction during the second pass through the fuser.

The net amount of shrink $S_{PE2}$, after re-growth, that occurs on side 2 in the process direction during the first pass through the fuser, is:

$$S_{PE2}=(1+S_{PE1})/(1+f_{1P})-1 \tag{52}$$

$$Mp=(P_{ME1}+1)/(S_{PE1}+1)-1 \tag{53}$$

Where Mp is the original belt speed error.

To calculate the values for e, f, g and h, in mm, for example, to be used for the lateral and process margin calculations by adjusting for the magnification errors, the following equations are used.

$$e_{reg}=e_{\alpha\theta\phi/}(1+S_{LE1})-m_L*S/1000 \tag{54}$$

$$f_{reg}=f_{\alpha\theta\phi/}(1+S_{LE2})-m_L*S/1000 \tag{55}$$

$$g_{reg}=g_{\alpha\theta\phi/}(1+S_{PE1})-m_P*g_{nom} \tag{56}$$

$$h_{reg}=h_{\alpha\theta\phi/}(1+S_{PE2})+m_P*(PL-h_{nom}) \tag{57}$$

where PL=process length and the other parameters are defined, supra.

The process length is used in the equation for $h_{reg}$ because the system used in this example is trail-edge registered on side 2.

Eqs. 54–57 specify what the distances $e_{reg}$, $f_{reg}$, $g_{reg}$ and $h_{reg}$ would have been had there been no target rotation, paper skew, raster output scanner (ROS) skew, or paper shrink effects.

The equations in this one-step setup also account for a margin error which may be induced by the individual paper skew correction used in a specific system's image on substrate/image on paper (IOS/IOP) adjustment requirements. The skew correction assumes that the two CCD sensors are offset in equal but opposite directions from the perfect registration edge. The corrections to the leading edge (LE) and trailing edge (TE) CCD pixel target essentially rotate the paper about a point halfway between the CCD sensors. If this assumption of equal and opposite mounting errors were true, the equations to correct for paper skew would eliminate the skew in the paper and place the onboard (OB) edge at the nominal registration edge.

Whenever the positioning errors of the CCD sensor are not equal and opposite, the paper skew corrections will still have eliminated the skew of the paper but they would not have placed the onboard (OB) edge of the paper at the nominal registration edge. This error would be equal to one half of the sum of the errors in the leading edge (LE) and trailing edge (TE) CCD sensor mounting positions. A byproduct of the one-step calculations is the fact that they account for this error and automatically correct for it as part of the lateral margin correction.

At the completion of the setup operation, the registration is designed to be "perfect" at the outboard edge of the first side and the second side, at the leading edge of the first side, and at the trailing edge of the second side.

In various exemplary embodiments of the systems and methods according to this invention, performing the registration setup operation includes printing a registration test image on both a first side and a second side of a sheet, obtaining data by measuring the first image on the first side and the second image on the second side, analyzing the measurement data, solving the equations outlined above or similar equations, and adjusting various process parameters of the electrophotographic or other printer, including correcting a pixel clock frequency and/or a photoreceptor belt or drum speed, adjusting the first pixel delay after the start of scan (SOS) signal, varying the sheet timing and/or position in the paper path, adjusting the ROS angular position relative to the photoreceptor belt among other techniques, based on the analyzed data.

Figure 13A:
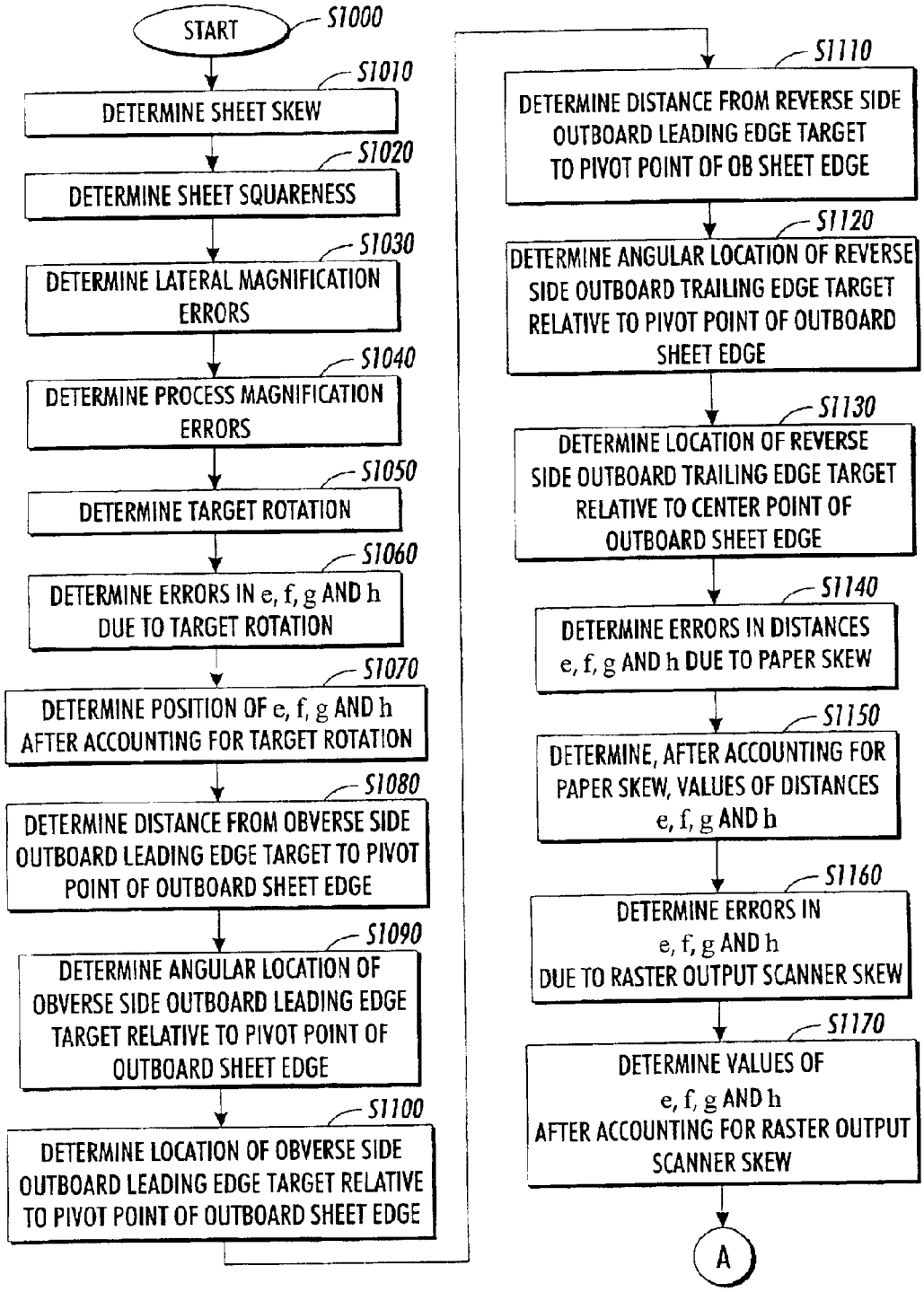
FIGS. 13A and 13B are a flowchart outlining one exemplary embodiment of a method of sheet registration according to the invention.
Figure 13B:
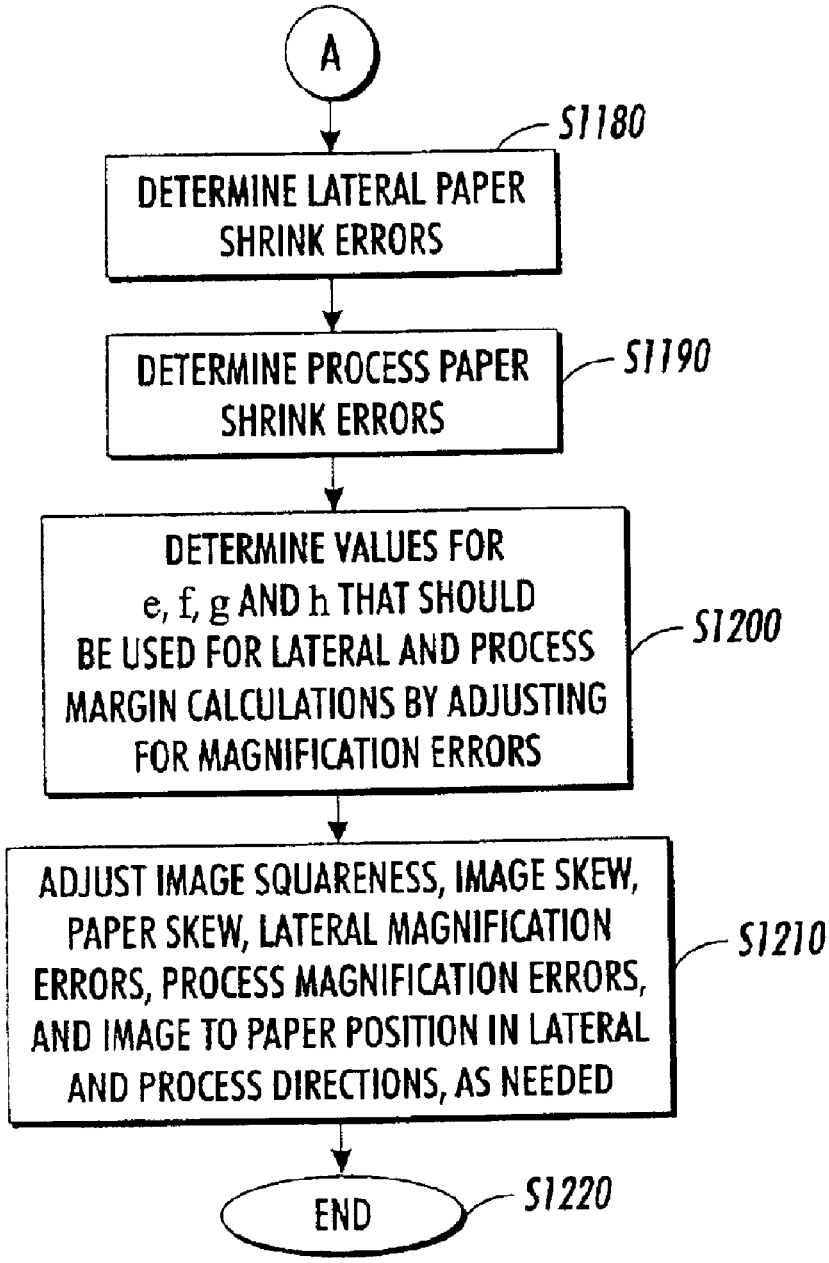

FIGS. 13A and 13B are a flowchart outlining one exemplary embodiment of a method for calculating and correcting registration errors according to this invention. As shown in FIGS. 13A and 13B, beginning in step S1000, operation continues to step S1010, where the sheet skew is determined. Then, in step S1020, the sheet squareness is determined. Next, in step S1030, the lateral magnification errors are determined. Operation then continues to step S1040.

In step S1040, the process magnification errors are determined. Next, in step S1050, the target rotation is determined. Then, in step S1060, errors in the distances e, f, g and h due to target rotation are determined. Operation then continues to step S1070.

In step S1070, the positions of the distances e, f, g and h are determined after accounting for the target rotation. Then, in step S1080, the distance from the obverse side outboard leading edge target to the pivot point of the outboard sheet edge is determined. Next, in step S11090, the angular location of the obverse side outboard leading edge target to the pivot point is determined. Operation then continues to step

S1100.

In step S1100, the location of the obverse side outboard leading edge target relative to the pivot point of the outboard sheet edge is determined. Then, in step S1110, the distance from the reverse side outboard leading edge target to the pivot point of the outboard sheet edge is determined. Next, in step S1120, the angular location of the reverse side outboard leading edge target relative to the pivot point if the outboard sheet edge is determined. Operation then continues to step S1130.

In step S1130, the location of the reverse side outboard leading edge target relative to the center point of the outboard sheet edge is determined. Next, in step S1140, errors in the distances e, f, g, and h due to paper skew are determined. Then, in step S1150, the values of the distances e, f, g, and h are determined after accounting for paper skew. Operation then continues to step S1160.

In step S160, errors in the distances e, f, g and h due to raster output scanner (ROS) skew are determined. Then, in step S1170, the values of the distances e, f, g and h are determined after accounting for ROS skew. Next, in step S1180, the lateral paper shrink errors are determined. Operation then continues to step S11190. In step S11190, the process paper shrink errors are determined. Next, in step S1200, the values for the distances e, f, g and h that should be used for lateral and process margin calculations by adjusting for magnification errors are determined. In step S1210, the values determined in steps S1010 through S1200 are used to adjust the orientation of subsequent sheets, for example, by adjusting one or more of the image squareness, the image skew, the paper skew, the lateral magnification, the process magnification, the image to paper positions in the lateral and process directions. Operation then continues to step S1220, where operation of the method ends.

The process magnification may be adjusted by varying the speed of the photoreceptor belt. The lateral magnification may be adjusted by modifying the pixel clock frequency. The paper skew can be modified by adjusting the target position of the paper in the registration system using one or more CCD sensors and sheet drive motors, for example. The process position may be modified by adjusting the time a sheet arrives at the transfer station. The lateral position can be changed by shifting the target position of the paper in the registration system using one or more CCD sensors and sheet drive motors or by adjusting the image using the first pixel delay after the start of scan signal of the raster output scanner unit. The image skew can be modified by adjusting the raster output scanner angular position of the raster output scanner relative to the photoreceptor belt.

Reference is made in this regard to U.S. Pat. Nos. 4,248,528; 4,627,721; 4,831,420; 5,153,577; 5,260,725; 5,555,084; 5,642,202; 5,697,608; 5,697,609; 5,760,914; 5,794,176; 5,821,971; 5,889,545; 5,892,854; 6,137,517; 6,141,464; 6,178,031; 6,201,937 and 6,275,244, each incorporated herein by reference in its entirety, which illustrate various methods and systems for adjusting image on paper registration parameters to achieve image squareness, image skew, paper skew, lateral magnification, process magnification, lateral direction image to paper position and process direction image to paper position.

The test pattern may be resident in software and printed out by a digital printer, should the invention be used with a digital printer, and/or it may be scanned into a copy printer and printed out as a test pattern on a sheet, and/or it may be imaged from a document platen, for example.

An exemplary embodiment of the sheet 100 on which a registration test pattern has been printed is illustrated in FIG. 1. In this embodiment, the registration test pattern comprises four cross-hairs 105, 110, 115 and 120 printed in the corners of the sheet 100. According to the systems and methods of the invention, various measurements of the relationship between the position of the marks 105, 110, 115 and 120 of the test pattern, and the position of the test pattern on the sheet 100 are performed for both sides of a duplex printed sheet.

The registration test pattern can be any pattern that permits useful measurements of the first and second images and their positions on the sheet 100 to be made. Any suitable known or later developed pattern that permits measurement of parameters of an image that are usable in the systems and methods according to this invention can be used as the registration test image. However, the registration test image should, at least, permit the sizes of the first side image and the second side image in the lateral and process directions to be measured and thus compared.

As indicated above, data is obtained by measuring a first image on the first side and a second image on the second side. Obtaining the data can include any suitable known or later developed method of measuring the sizes of the first and second images and determining the positions of the first and second images on the sheet 100. Measurements can be taken by any known or later developed, manual or automated method. Similarly, obtaining the data can include storing the data into any suitable storage or memory device, including, but not limited to, electronic memory. Obtaining the data can also include accessing data that has already been obtained, stored or recorded in prior processes.

Analyzing the data can include any known or later developed, manual or automated process of evaluating the obtained data. Analyzing the data can include employing the data in any routine or algorithm that will provide adjustments to overcome magnification error associated with pixel clock frequency error and photoreceptor belt or drum speed error.

Adjusting the image forming/printing device components, including the pixel clock frequency and/or the photoreceptor belt or drum speed includes any suitable known or later developed method of adjusting the pixel clock frequency and/or the photoreceptor belt or drum speed, using the adjustments obtained in analyzing the data. Adjusting pixel clock frequency and/or photoreceptor belt or drum speed also includes any mechanical or electrical manipulations that are made to alter the pixel clock frequency and/or the photoreceptor belt or drum speed. This also includes any electronic or mechanical processes for implementing the adjustments.

In various exemplary embodiments, all values used in Eqs. 1–57, can be determined during the setup operation and stored in the non-volatile memory of the printing device. In various other exemplary embodiments, the measurements and determinations can be made at least in part by the user.

According to this invention, applying the margin shifts can include any manual or automated process of manipulating the sheet or printing apparatus to achieve the desired margin shifts.

Figure 14:
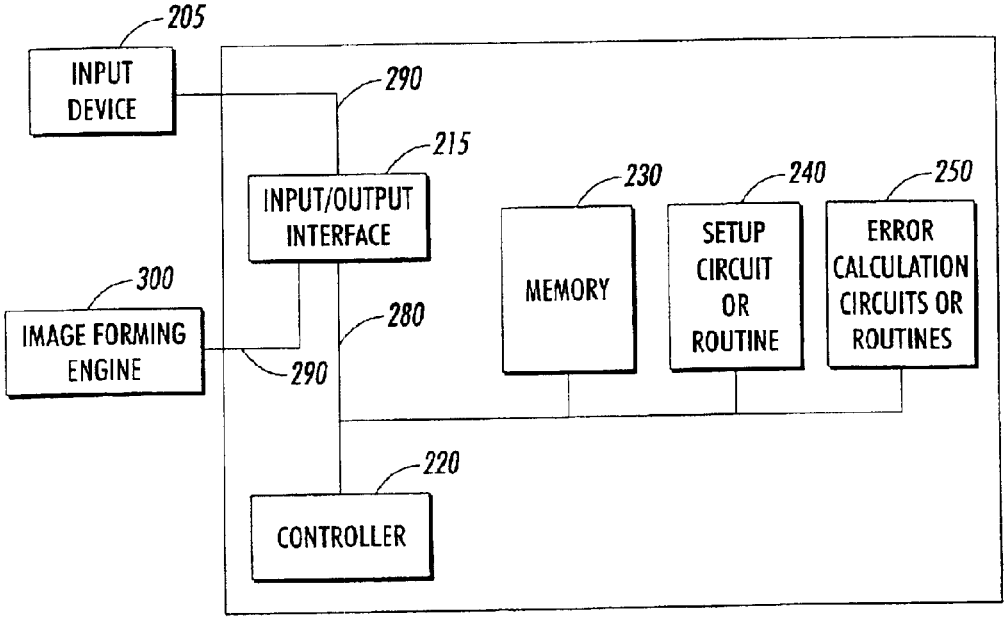
FIG. 14 is a functional block diagram of one exemplary embodiment of a control system according to this invention.

FIG. 14 is a functional block diagram of one exemplary embodiment of the control system 200 according to this invention, usable to generate and apply the corrections discussed above, and to controllably output the shifted image data to an image forming engine 300 based on the determined corrections. As shown in FIG. 13, the control system 200 includes an input/output interface 215, a controller 220, a memory 230, a setup circuit or routine 240, a residual magnification error determining circuit or routine 250, a margin shift determining circuit or routine 260, and a margin shift applying circuit or routine 270, interconnected by a data/control bus or the like 280. One or more input devices 205 are connected by a link 290 with the input/output interface 215.

As shown in FIG. 14, the memory 230 can be implemented using either or both of alterable or non-alterable memory. In FIG. 14, the alterable portions of the memory 230 are, in various exemplary embodiments, implemented using static or dynamic RAM. However, the alterable portions of the memory 230 can also be implemented using a floppy disk and disk drive, a writable optical disk and disk drive, a hard drive, flash memory or the like. In FIG. 14, in the memory 230, the non-alterable portions of the memory 230 are each, in various exemplary embodiments, implemented using ROM. However, the non-alterable portions can also be implemented using other memory devices, such as PROM, EPROM, EEPROM, an optical ROM disk, such as a CD-ROM or a DVD-ROM, and disk drive, or other non-alterable memory, or the like.

Thus, the memory 230 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and disk drive, a writable or re-writable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or a DVD-ROM disk and disk drive or the like.

It should be appreciated that the control system 200 shown in FIG. 14 can be implemented as a portions of a programmed general purpose computer used to control the overall operation of the image forming engine. Alternatively, the control system 200 can be implemented using an ASIC, a FPGA, a PLD, a PLA, or a PAL, or using physically distinct hardware circuits, such as discrete logic elements or discrete circuit elements. The particular form the controller 220 shown in FIG. 13 will take is a design choice and will be obvious and predictable to those skilled in the art. Alternatively, the control system 200 can be implemented as a portion of a software program usable to form the overall control system of the image forming engine. In this case, each of the controller 220 and the various circuits or routines 240–270 can be implemented as software routines, objects and/or application programming interfaces or the like.

In general, the one or more input devices 205 will include any one or more of a keyboard, a keypad, a mouse, a track ball, a track pad, a touch screen, a microphone and associate voice recognition system software, a joy stick, a pen base system, or any other known or later-developed system for providing control and/or data signals to the control system 200. The input device 205 can further include any manual or automated device usable by a user or other system to present data or other stimuli to the control system 200.

The link 290 can be any known or later-developed device or system for connecting the input device 205 to the control system 200, including a direct cable connection, a connection over a wide area network or a local area network, a connection over an intranet, a connection over the Internet, or a connection over any other known or later-developed distributed processing network or system. In general, the link 290 can be any known or later-developed connection system or structure usable to connect the input device 205 to the control system 200.

In operation, the user operates the control system 200 to cause the image forming engine to print a registration test image, such as that shown in FIG. 1, on the first and second sides of a sheet. The user then automatically or manually measures the parameters listed above. The measurements may be manually entered into the input device 205 to submit measurements obtained manually from the registration test image to the control system 200, or they are automatically entered into the controller if the measurements are made automatically. The various measurements obtained from the registration test image are then stored by the controller 220 in the memory 230.

The controller 220 then accesses the measurements stored in the memory 230 and supplies the accessed measurements to the calculation circuit 237 which performs the calculations and determinations set forth in Eqs. 1–57. The calculation circuit 237 provides the results of the calculations to the setup routine or circuit 240. The setup routine or circuit 240, under control of the controller 220 and in cooperation with the image forming engine 300, adjusts the registration altering elements of the printer, such as, for example, the speed of the photoreceptor belt or drum and/or the pixel clock frequency, the start of scan and/or the end of scan location of the raster output scanner, the photoreceptor belt location, the photoreceptor differential speed, among other elements, as necessary to perform the setup registration. Upon completing the setup operation performed by the setup routine or circuit 240, the controller 220 stores the data generated by the setup circuit or routine 240, including but not limited to the nature and extent of the adjustments to the pixel clock frequency and/or the photoreceptor belt or drum speed, in the memory 230. The adjustment data is then output under the control of the controller 220 through the input/output interface 215 by the link 290 and the data/control bus or the like 290 to the image forming engine 300.

While this invention has been described in conjunction with the specific embodiments above, it is evident that many alternatives, combinations, modifications, and variations are apparent to those skilled in the art. Accordingly, the preferred embodiments of this invention, as set forth above are intended to be illustrative, and not limiting. Various changes can be made without departing from the spirit and scope of this invention.

What is claimed is:

1. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to provide a single step error correction of at least two operational parameters of the image forming device.

2. The method of claim 1, wherein:

printing the test pattern includes printing the test pattern on both a first side of the image recording medium and on a second side of the image recording medium;

measuring the test pattern parameters comprises measuring the test pattern parameters on both the first side and the second side of the image recording medium; and adjusting at least one operational parameter includes adjusting at least one of a pixel clock frequency, a photoreceptor speed and at least one image-on-paper actuator based on the determined errors.

3. The method of claim 1, wherein the test pattern comprises a plurality of crosshair targets.

4. The method of claim 1, wherein a sheet position is registered at an outboard edge and at a leading edge of the sheet for an obverse side of the sheet.

5. The method of claim 1, wherein the image forming device includes a raster output scanner (ROS), a pixel clock and/or a movable photoreceptor belt and drum, and a paper path; and wherein adjusting the at least one operational parameter comprises simultaneously adjusting a pixel clock frequency and/or a photoreceptor belt or drum speed, adjusting the first pixel delay after the start of scan location, varying sheet position or timing in the paper path, adjusting angular position of the ROS relative the photoreceptor belt.

6. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein the at least one measured test pattern parameter includes at least one of a distance from a center of a leading edge crosshair located near an inboard leading edge of the image recording medium to a center of a trailing edge crosshair located near an outboard edge of the image recording medium, a distance from the center of a leading edge crosshair located near an outboard leading edge of the sheet to the outboard edge of the sheet, a distance between the center of a leading edge inboard crosshair to the center of a leading edge outboard crosshair, a distance between the center of a leading edge outboard crosshair to the center of a trailing edge outboard crosshair, and a measured distance between a leading edge of the sheet to the center of a leading edge outboard crosshair, and a distance between a trailing edge of the sheet to the center of a trailing edge outboard crosshair.

7. A method of setting un image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein determining at least two registration error in paper skew comprises measuring the test pattern parameters of $d_1$, $e_1$, $f_1$, $d_2$, $e_2$ and $f_2$ and performing at least one geometrical transformation, including $$\theta=(\tan^{-1}[(f_1-e_1)/d_1]+\tan^{-1}[(f_2-e_2)/d_2])/_2$$

where $\theta$ is the amount of rotation of the sheet about the outboard registration edge of the sheet, $d_1$ is the distance between the two leading edge (LE) crosshair centers on the first side of the sheet, $e_1$ is the distance from the outboard (OB) edge of the sheet to the center of the leading edge (LE) outboard (OB) crosshair on the first side of the sheet, $f_1$ is the distance from the outboard (OB) edge of the sheet to the center of the trailing edge (TE) outboard (OB) crosshair on the first side of the sheet, $d_2$ is the distance between the two leading edge (LE) crosshair centers on the second side of the sheet, $e_2$ is the distance from the outboard (OB) edge of the sheet to the center of the leading edge (LE) outboard (OB) crosshair on the second side of the sheet, and $f_2$ is the distance from the outboard (OB) edge of the sheet to the center of the trailing edge (TE) outboard (OB) crosshair on the second side of the sheet.

8. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein the image forming device comprises a photoreceptor belt; and wherein determining at least one registration error in raster output scanner skew comprises at least one geometrical transformation, including $$\phi=(=_1+\phi_2)/2$$

where:

$\phi$ is the amount of rotation of the raster output scanner about an axis perpendicular to the photoreceptor belt surface;

$\phi_1$ is the amount of rotation of the raster output scanner about an axis perpendicular to the photoreceptor belt surface for first side of the sheet; and $\phi_2$ is the amount of rotation of the raster output scanner about an axis perpendicular to the photoreceptor belt surface for second side of the sheet.

9. A method of setting up image-on-recording medium of an image forming device, comprising:

generating a test pattern;

printing the test pattern on an image recording medium sheet;

measuring at least one test pattern parameter;

using the at least one measured test pattern parameters to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein determining at least one registration error comprises performing at least one geometrical transformation, including $$L_{ME}=(L_{ME1}+L_{ME2})/2$$

where:

$L_{ME}$ is lateral magnification error of the sheet;

$L_{ME1}$ is lateral magnification error for first side of the sheet; and $L_{ME2}$ is lateral magnification error for second side of the sheet.

10. A method of setting un image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein determining at least one registration error involves at least one geometrical transformation, including $$P_{ME}=(P_{ME1}+P_{ME2})/2$$

where:

$P_{ME}$ is process magnification error;

$P_{ME1}$ is process magnification error for first side of the sheet; and $P_{ME2}$ is process magnification error for second side of the sheet.

11. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein the image forming device has a photoreceptor belt and the sheet has an outboard registration edge; and wherein determining at least one registration error involves at least one geometrical transformation, including $$\alpha=\phi-\theta$$

where $\alpha$ is target rotation;

$\phi$ is the amount of rotation of the raster output scanner about an axis perpendicular to the photoreceptor belt surface; and $\theta$ is the amount of rotation of the sheet about the outboard registration edge of the sheet.

12. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least one error to adjust at least one operational parameter of the image forming device; and, wherein the sheet has an outboard registration edge; and wherein determining at least one registration error in involves at least one geometrical transformation, including $$\Delta h_{\alpha}=h_2*(1-\cos(\theta))$$

where:

$\theta$ is the amount of rotation of the sheet about the outboard registration edge of the sheet; and $h_2$ is the distance from the trailing edge of second side of the sheet to the center of a trailing edge outboard crosshair located on the test pattern.

13. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein the sheet has an outboard edge and an outboard edge pivot point; and wherein determining at least one registration error in image to sheet position in the lateral direction involves at least one geometrical transformation which determines the distance from the pivot point of the outboard sheet edge to a sheet leading edge target.

14. A method of setting up image-on-recording medium of an image forming device, comprising:

generating a test pattern;

printing the test pattern on an image recording medium sheet;

measuring at least one test pattern parameter;

using the at least one measured test pattern parameter to determine at least two registration errors in at least one of image squareness, image skew, sheet skew, process magnification, lateral magnification, image to sheet position in the lateral direction and image to sheet position in the process direction; and using the determined at least two registration errors to adjust at least one operational parameter of the image forming device;

wherein the test pattern comprises a LE target and the sheet has an outboard edge and an outboard edge pivot point; and wherein determining at least one registration error in image to sheet position in the process direction involves at least one geometrical transformation which determines an angular position of the LE target relative to the pivot point of the outboard edge of the sheet.

15. A control system usable to control a printing device, the printing device having a raster optical scanner, a photoreceptor belt or drum having a surface, a fuser, a raster output scanner (ROS), a pixel clock, and a paper path; and wherein comprising:

an input device;

an input/output interface;

a controller;

at least one memory;

a setup circuit or routine that generates a test pattern, the test pattern comprising a LE target and the sheet has an outboard edge and an outboard edge pivot point, the test pattern being printed on a recording medium sheet, the setup circuit or routine using measured test pattern parameters obtained from the printed test pattern to determine registration errors in at least one of image squareness, image skew, sheet skew, process magnification, lateral magnification, image to sheet position in the lateral and process directions, and that uses the determined errors to simultaneously reduce at least two of the determined registration errors.

16. The control system of claim 15, further including:

a system to print the test pattern on a first side of the image recording medium and on the second side of the image recording medium;

a system to measure test pattern parameters on the first side image and the second side image; and a system to correct said errors by adjustment of at least one of a pixel clock frequency and a photoreceptor speed based on the determined errors.

17. The control system of claim 15, wherein the test pattern comprises a plurality of crosshair targets.

18. The control system of claim 15, wherein a measured test pattern parameter is a sheet pivot point, a distance from a center of a leading edge crosshair located near the inboard leading edge of the sheet to a center of a trailing edge crosshair located near the outboard edge of the sheet, a distance from a center of a leading edge crosshair located near the outboard leading edge of the sheet to an outboard edge of the sheet, a distance between a center of a leading edge inboard crosshair to the center of a leading edge outboard crosshair, a distance between a center of a leading edge outboard crosshair to a center of a trailing edge outboard crosshair, a distance between a leading edge of the sheet to a center of a leading edge outboard crosshair, or a distance between a trailing edge of the sheet to the center of a trailing edge outboard crosshair.

19. The system of claim 15, wherein the test pattern has parameters and the sheet has an outboard registration edge; and wherein the setup circuit or routine to determine registration errors in paper skew comprises a circuit or routine to measure the test pattern parameters of $d_1$, $e_1$, $f_1$, $d_2$, $e_2$ and $f_2$ and to perform at least one geometrical transformation, including $$\theta=(\tan^{-1}[(f_1-e_1)/d_1]+\tan^{-1}[(f_2-e_2)/d_2]/2$$

where $\theta$ equals the amount of rotation of the sheet about the outboard registration edge of the sheet, $d_1$ is the distance between the two leading edge (LE) crosshair centers on the first side of the sheet, $e_1$ is the distance from the outboard (OB) edge of the sheet to the center of the leading edge (LE) outboard (OB) crosshair on the first side of the sheet, $f_1$ is the distance from the outboard (OB) edge of the sheet to the center of the trailing edge (TE) outboard (OB) crosshair on the first side of the sheet, $d_2$ is the distance between the two leading edge (LE) crosshair centers on the second side of the sheet, $e_2$ is the distance from the outboard (OB) edge of the sheet to the center of the leading edge (LE) outboard (OB) crosshair on the second side of the sheet, and $f_2$ is the distance from the outboard (OB) edge of the sheet to the center of the trailing edge (TE) outboard (OB) crosshair on the second side of the sheet.

20. The control system of claim 15, wherein determining at least one registration error in raster output scanner skew involves at least one geometrical transformation, including $$\phi=(\phi_1+\phi_2)/2$$

where:

$\phi$ equals the amount of rotation of the raster output scanner about an axis perpendicular to the photoreceptor belt surface;

$\phi_1$ is the amount of rotation of the raster output scanner about an axis perpendicular to the photoreceptor belt surface for first side of the sheet; and $\phi_2$ is the amount of rotation of the raster output scanner about an axis perpendicular to the photoreceptor belt surface for second side of the sheet.

21. The control system of claim 15, wherein determining at least one registration error in image skew involves at least one geometrical transformation, including $$L_{ME}=(L_{ME1}+L_{ME2})/2$$

where:

$L_{ME}$ is lateral magnification error of the sheet;

$L_{ME1}$ is lateral magnification error for first side of the sheet; and $L_{ME2}$ is lateral magnification error for second side of the sheet.

22. The control system of claim 15, wherein determining at least one registration error involves at least one geometrical transformation, including:

$$P_{ME}=(P_{ME1}+P_{ME2})/2$$

where:

$P_{ME}$ is process magnification error;

$P_{ME1}$ is process magnification error for first side of the sheet; and $P_{ME2}$ is process magnification error for second side of the sheet.

23. The control system of claim 15, wherein determining at least one registration error involves at least one geometrical transformation, including:

$$\alpha=\phi-\theta$$

where:

$\alpha$ is target rotation;

$\phi$ is the amount of rotation of the raster output scanner about an axis perpendicular to the photoreceptor belt surface; and $\theta$ is the amount of rotation of the sheet about the outboard registration edge of the sheet.

24. The control system of claim 15, wherein determining at least one registration error in image to sheet position in the lateral direction involves at least one geometrical transformation which determines the distance from the pivot point of the outboard sheet edge to a sheet leading edge target.

25. The control system of claim 15, wherein determining at least one registration error in image to sheet position in the process direction involves at least one geometrical transformation which determines an angular position of the LE target relative to the pivot point of the outboard edge of the sheet.

26. The control system of claim 15 wherein adjusting at least one operational parameter includes correcting a pixel clock frequency and/or a photoreceptor belt or drum speed, adjusting a first pixel delay after the start of scan location, adjusting sheet position or timing in the paper path, and adjusting angular position of the raster output scanner relative to the photoreceptor belt.

27. The control system of claim 20, wherein the sheet has an outboard registration edge, a leading edge and a trailing edge; and wherein determining at least one registration error involves at least one geometrical transformation, including:

$$\Delta h_{\alpha}=h_2*(1-\cos(\theta)),$$

where:

$\theta$ is the amount of rotation of the sheet about the outboard registration edge of the sheet; and $h_2$ is the distance from the trailing edge of second side of the sheet to the center of a trailing edge outboard crosshair located on the test pattern.

28. A method of determining and reducing image on sheet registration errors of a printing machine comprising:

providing a test pattern on a sheet;

making measurements of a plurality of registration errors based on the test pattern;

determining error corrections for the plurality of registration errors using an algorithm; and providing the error corrections to at least one of a printing machine or printing machine operator to correct the plurality of registration errors.

29. The method of claim 27, wherein the plurality of registration errors include two or more of image squareness, image skew, sheet skew, process magnification, lateral magnification, image to sheet position in the lateral direction and image to sheet position in the process direction.

30. A system of determining and reducing image on sheet registration
errors of a printing machine comprising:

a test pattern provider that provides a test pattern on a sheet;

a measurer that makes measurements of a plurality of registration errors based on the test pattern;

an error corrector that determines error corrections for the plurality of registration errors using an algorithm; and an error correction provider that provides error corrections to at least one of a printing machine or printing machine operator to correct the plurality of registration errors.

31. The system of claim 30, wherein the plurality of registration errors include two or more of image squareness, image skew, sheet skew, process magnification, lateral magnification, image to sheet position in the lateral direction and image to sheet position in the process direction.

32. A method of determining and reducing image on sheet registration errors of a printing machine comprising:

providing a test pattern on a sheet;

making measurements of a plurality of registration errors based on the test pattern;

determining error corrections for the plurality of registration errors using an algorithm; and providing the error corrections to at least one of a printing machine or printing machine operator to correct the plurality of registration errors in a single step.

33. A system of determining and reducing image on sheet registration errors of a printing machine comprising:

a test pattern provider to provide a test pattern on a sheet;

a measurer to making measurements of a plurality of registration errors based on the test pattern;

an error corrector to determine error corrections for the plurality of registration errors using an algorithm; and an error correction provider to provide error corrections to at least one of a printing machine or printing machine operator to correct the plurality of registration errors in a single step.

* * * * *